US011352590B2

(12) United States Patent
Pulukkody et al.

(10) Patent No.: US 11,352,590 B2
(45) **Date of Patent: *Jun. 7, 2022**

(54) AQUEOUS LIGHT DUTY LIQUID DETERGENT FORMULATION

(71) Applicants: Rohm and Haas Company, Collegeville, PA (US); Dow Global Technologies LLC, Midland, MI (US)

(72) Inventors: Randara Pulukkody, Landsdale, PA (US); Akanksha Agrawal, Cupertino, CA (US); Daniel S. Miller, Phoenixville, PA (US); Andrea C. Keenan, Pottstown, PA (US); Jan E. Shulman, Newtown, PA (US)

(73) Assignees: Dow Global Technologies LLC, Midland, MI (US); Rohm and Haas Company, Collegeville, PA (US)

( * ) Notice: Subject to any disclaimer, the term of this patent is extended or adjusted under 35 U.S.C. 154(b) by 30 days.

This patent is subject to a terminal disclaimer.

(21) Appl. No.: 16/971,778

(22) PCT Filed: Mar. 14, 2019

(86) PCT No.: PCT/US2019/022223

§ 371 (c)(1),
(2) Date: Aug. 21, 2020

(87) PCT Pub. No.: WO2019/194948

PCT Pub. Date: Oct. 10, 2019

(65) Prior Publication Data

US 2021/0363469 A1 Nov. 25, 2021

Related U.S. Application Data

(60) Provisional application No. 62/652,389, filed on Apr. 4, 2018.

(51) Int. Cl.

| | |
|---|---|
| ***C11D 1/02*** | (2006.01) |
| ***C11D 1/22*** | (2006.01) |
| ***C11D 1/29*** | (2006.01) |
| ***C11D 1/75*** | (2006.01) |
| ***C11D 3/20*** | (2006.01) |
| ***C11D 3/38*** | (2006.01) |
| ***C11D 3/50*** | (2006.01) |
| ***B08B 3/04*** | (2006.01) |
| ***C11D 3/382*** | (2006.01) |
| ***C11D 1/14*** | (2006.01) |
| ***C11D 11/00*** | (2006.01) |
| ***C11D 17/00*** | (2006.01) |

(52) U.S. Cl.

CPC ..... *C11D 3/382* (2013.01); *C11D 1/146* (2013.01); *C11D 1/75* (2013.01); *C11D 3/2068* (2013.01); *C11D 3/2093* (2013.01); *C11D 11/0029* (2013.01); *C11D 11/0035* (2013.01); *C11D 17/0008* (2013.01)

(58) Field of Classification Search

CPC .... C11D 1/02; C11D 1/22; C11D 1/29; C11D 1/667; C11D 1/75; C11D 3/188; C11D 3/20; C11D 3/38; C11D 3/50; B08B 3/04

See application file for complete search history.

(56) References Cited

U.S. PATENT DOCUMENTS

| | | | | |
|---|---|---|---|---|
| 4,921,694 | A | 5/1990 | Hoppe et al. | |
| 5,424,010 | A | 6/1995 | Duliba et al. | |
| 5,646,104 | A | 7/1997 | Erilli et al. | |
| 2012/0015857 | A1 | 1/2012 | Chen et al. | |
| 2015/0017214 | A1 | 1/2015 | Warr et al. | |
| 2021/0009923 | A1* | 1/2021 | Miller | C11D 1/667 |

FOREIGN PATENT DOCUMENTS

| | | | | |
|---|---|---|---|---|
| EP | 2940114 | | 11/2015 | |
| JP | 2006320883 | | 11/2006 | |
| JP | 2008195676 | | 8/2008 | |
| WO | 2012054465 | A2 | 4/2012 | |
| WO | WO 2012/054465 | * | 4/2012 | C11D 1/66 |

OTHER PUBLICATIONS

Sibilia, "A Guide to Materials Characterization and Chemical Analysis", 1988, p. 81-84s.

* cited by examiner

*Primary Examiner* — Brian P Mruk
(74) *Attorney, Agent, or Firm* — Thomas S. Deibert

(57) ABSTRACT

An aqueous light duty liquid detergent formulation is provided including a water; an essential oil; a derivative of castor oil having a formula selected from formula I and formula II; an ethoxylated phenol having formula III; an anionic surfactant and a zwitterionic surfactant. Also provided is a method of cleaning an article using the aqueous light duty liquid detergent formulation.

10 Claims, No Drawings

AQUEOUS LIGHT DUTY LIQUID DETERGENT FORMULATION

This application is a 371 of PCT/US2019/022223, filed on Mar. 14, 2019, which claims benefit of Provisional Ser. No. 62/652,389, filed on Apr. 4, 2018.

The present invention relates to an aqueous light duty liquid detergent formulation. In particular, the present invention relates to an aqueous light duty liquid detergent formulation including a water; an essential oil; a derivative of castor oil having a formula selected from formula I and formula II; an ethoxylated phenol having formula III; an anionic surfactant and a zwitterionic surfactant.

Aqueous cleaning compositions, for example, floor care formulations, hard surface cleaning formulations and personal care formulations have a wide array of uses. For example, use cleaning hard surfaces such as floors, counters, walls, tables, and other things made of, for example, wood, stone, laminate, ceramic and plastic materials which need to be cleaned periodically of accumulated dirt, oil, grease, and other contaminants.

Aqueous light duty liquid detergent formulations are commonly used in hand dishwashing liquids, shampoos, cleaners, and some laundry applications. These aqueous light duty liquid detergent formulations typically include an anionic surfactant, which is the principal suds producer, along with a secondary surfactant.

Aqueous light duty liquid detergent formulations also commonly include fragrances. Notwithstanding, the incorporation of certain essential oil based fragrances, while desirable from a scent perspective, often proves difficult from a formulation perspective. Specifically, the primarily hydrophobic nature of essential oil based fragrances makes solubilization of these molecules in aqueous, surfactant containing formulations, challenging. Poorly solubilized fragrances can cause formulation instability leading to, inter alia, undesired phase separation.

Duliba et al. provide a light duty liquid detergent formulation in U.S. Pat. No. 5,424,010. Duliba et al disclose a light duty, liquid hand washing composition which is mile, stable foaming composition especially effective in cleaning dishware, glasses, flatware, pots, pans, and delicate clothing by hand at ambient wash water temperature, as well as at warm or hot wash water temperatures. The composition comprises from about 20% to about 40% by weight of at least one anionic or nonionic surfactant; from about 0.5 to about 3.5% by weight of an alcohol which is 3-methyl-3-methoxybutanol; from about 2% to about 8% of at least one hydrotrope; and from about 50% to about 70% water. The composition has a pH in the range of from about 6.0 to about 8.0 and a viscosity in the range of from about 100 cps to about 500 cps.

Notwithstanding, there remains a continuing need for effective aqueous light duty liquid detergent formulations. In particular, there remains a need for effective aqueous light duty hand dish liquid detergent formulations that provide cleaning action, a pleasant fragrance and formulational stability.

The present invention provides an aqueous light duty liquid detergent formulation, comprising: a water; an essential oil; a derivative of castor oil having a formula selected from formula I and formula II (I)

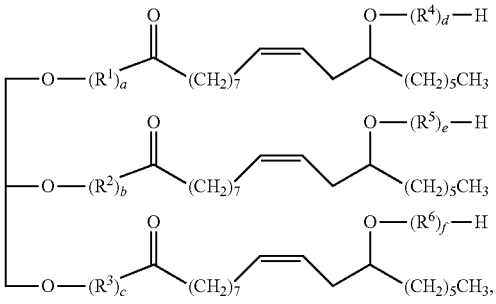

and (II)

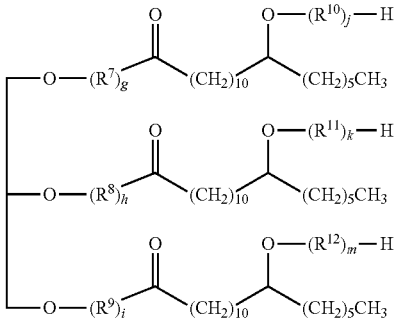

wherein $R^1$, $R^2$, $R^3$, $R^4$, $R^5$, $R^6$, $R^7$, $R^1$, $R^9$, $R^{10}$, $R^{11}$ and $R^{12}$ are each independently selected from a —$CH_2CH_2O$— group, a —$CH_2CH_2CH_2O$— group, a —$CH_2CH_2CH_2CH_2O$— group, a —$CH(CH_3)CH_2O$— group, a —$CH_2CH(CH_3)O$— group, a —$CH(CH_3)CH_2CH_2O$— group, a —$CH_2CH(CH_3)CH_2O$— group and a —$CH_2CH_2CH(CH_3)O$— group; wherein a, b, c, d, e, f, g, h, i, j, k and m are each independently a number of 0 to 250; wherein the average sum of a+b+c+d+e+f is 1 to 250; wherein the average sum of g+h+i+j+k+m is 1 to 250; an ethoxylated phenol having formula III (III)

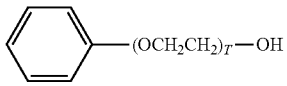

wherein T is an average of 5 to 8; an anionic surfactant; and a zwitterionic surfactant.

The present invention provides an aqueous light duty liquid detergent formulation, comprising: a water; an essential oil; a derivative of castor oil having a formula selected from formula I and formula II, wherein $R^1$, $R^2$, $R^3$, $R^4$, $R^5$, $R^6$, $R^7$, $R^8$, $R^9$, $R^{10}$, $R^{11}$, and $R^{12}$ are each a —$CH_2CH_2O$— group; wherein a, b, c, d, e, f, g, h, i, j, k and m are each independently a number of 0 to 250; wherein the average sum of a+b+c+d+e+f is 1 to 250; wherein the average sum of g+h+i+j+k+m is 1 to 250; an ethoxylated phenol having formula III, wherein T is an average of 5 to 8; an anionic surfactant; a zwitterionic surfactant; and an organic solvent.

The present invention provides an aqueous light duty liquid detergent formulation, comprising: a water; an essential oil; a derivative of castor oil having a formula selected from formula I and formula II, wherein $R^1$, $R^2$, $R^3$, $R^4$, $R^5$, $R^6$, $R^7$, $R^8$, $R^9$, $R^{10}$, $R^{11}$, and $R^{12}$ are each a —$CH_2CH_2O$— group; wherein a, b, c, d, e, f, g, h, i, j, k and m are each independently a number of 0 to 250; wherein the average sum of a+b+c+d+e+f is 1 to 250; wherein the average sum of g+h+i+j+k+m is 1 to 250; an ethoxylated phenol having formula III, wherein T is an average of 5 to 8; an anionic surfactant; a zwitterionic surfactant; and a hydrotrope.

The present invention provides an aqueous light duty liquid detergent formulation, comprising: a water; an essential oil; a derivative of castor oil having a formula selected from formula I and formula II, wherein $R^1$, $R^2$, $R^3$, $R^4$, $R^5$, $R^6$, $R^7$, $R^8$, $R^9$, $R^{10}$, $R^{11}$, and $R^{12}$ are each a —$CH_2CH_2O$— group; wherein a, b, c, d, e, f, g, h, i, j, k and m are each independently a number of 0 to 250; wherein the average sum of a+b+c+d+e+f is 1 to 250; wherein the average sum of g+h+i+j+k+m is 1 to 250; an ethoxylated phenol having formula III, wherein T is an average of 5 to 8; an anionic surfactant; a zwitterionic surfactant; and an antibacterial agent.

The present invention provides a method of manually washing an article, comprising: providing an article, wherein the article is selected from the group consisting of at least one of dishware, glassware, flatware, pots, pans and delicate clothing; providing an aqueous light duty liquid detergent formulation of the present invention; manually contacting the article with the aqueous light duty liquid detergent formulation; and rinsing the aqueous light duty liquid detergent formulation from the article.

DETAILED DESCRIPTION

The aqueous light duty liquid detergent formulation of the present invention provides cleaning action and a pleasant fragrance, wherein the aqueous cleaning formulation remains stable with a high fragrance loading, wherein the fragrance is an otherwise difficult to stably incorporate essential oil based fragrance.

Unless otherwise indicated, ratios, percentages, parts, and the like are by weight. Weight percentages (or wt %) in the composition are percentages of dry weight, i.e., excluding any water that may be present in the composition. Percentages of monomer units in the polymer are percentages of solids weight, i.e., excluding any water present in a polymer emulsion.

As used herein, unless otherwise indicated, the terms "weight average molecular weight" and "Mw" are used interchangeably to refer to the weight average molecular weight as measured in a conventional manner with gel permeation chromatography (GPC) and conventional standards, such as polyethylene glycol standards. GPC techniques are discussed in detail in Modem Size Exclusion Chromatography, W. W. Yau, J. J. Kirkland, D. D. Bly; Wiley-Interscience, 1979, and in A Guide to Materials Characterization and Chemical Analysis, J. P. Sibilia; VCH, 1988, p. 81-84. Weight average molecular weights are reported herein in units of Daltons.

Preferably, the aqueous light duty liquid detergent formulation of the present invention is a hard surface cleaning formulation. More preferably, the aqueous light duty liquid detergent formulation of the present invention is a hand dishwashing liquid.

Preferably, the aqueous light duty liquid detergent formulation of the present invention, comprises: water (preferably, 10 to 99 wt % (more preferably, 25 to 98 wt %; most preferably, 50 to 97 wt %), based on the weight of the aqueous light duty liquid detergent formulation, of the water); an essential oil (preferably, 0.01 to 10 wt % (more preferably, 0.01 to 5 wt %), based on the weight of the aqueous light duty liquid detergent formulation, of the essential oil); a derivative of castor oil (preferably, 0.01 to 25 wt % (more preferably, 0.05 to 10 wt %; still more preferably, 0.1 to 5 wt %; most preferably, 1 to 3 wt %), based on the weight of the aqueous light duty liquid detergent formulation, of the derivative of castor oil) having a formula selected from formula I and formula II (I)

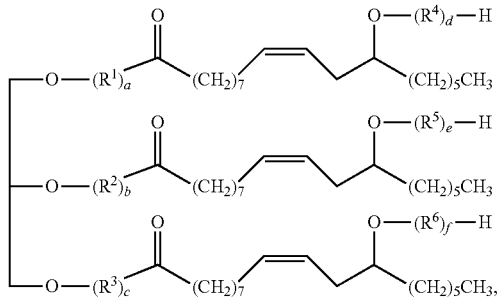

and (II)

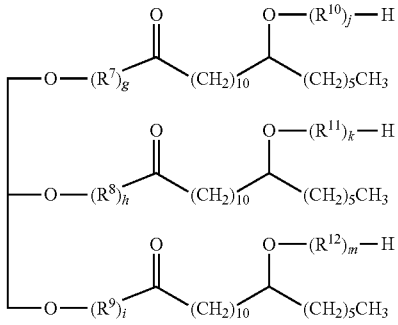

wherein $R^1$, $R^2$, $R^3$, $R^4$, $R^5$, $R^6$, $R^7$, $R^8$, $R^9$, $R^{10}$, $R^{11}$ and $R^{12}$ are each independently selected from a —$CH_2CH_2O$— group, a —$CH_2CH_2CH_2O$— group, a —$CH_2CH_2CH_2CH_2O$— group, a —$CH(CH_3)CH_2O$— group, a —$CH_2CH(CH_3)O$— group, a —$CH(CH_3)CH_2CH_2O$— group, a —$CH_2CH(CH_3)CH_2O$— group and a —$CH_2CH_2CH(CH_3)O$— group (preferably, a —$CH_2CH_2O$— group and a —$CH_2CH_2CH_2O$— group; more preferably, a —$CH_2CH_2O$— group); wherein a, b, c, d, e, f, g, h, i, j, k and m are each independently a number of 0 to 250; wherein the average sum of a+b+c+d+e+f is 1 to 250; wherein the average sum of g+h+i+j+k+m is 1 to 250; an ethoxylated phenol (preferably, 0.01 to 30 wt % (more preferably, 0.1 to 20 wt %; still more preferably, 1 to 10 wt %; most preferably, 2.5 to 7.5 wt %), based on the weight of the aqueous cleaning formulation, of the ethoxylated phenol) having formula III (III)

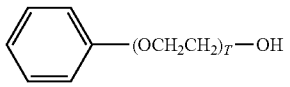

wherein T is an average of 5 to 8 (preferably, 5.25 to 7.5; more preferably, 5.5 to 7.25; most preferably, 5.75 to 6.25); an anionic surfactant (preferably, 0.01 to 35 wt % (more preferably, 10 to 30 wt %; most preferably, 15 to 25 wt %), based on the weight of the aqueous cleaning formulation, of the anionic surfactant); and a zwitterionic surfactant (preferably, 0.01 to 15 wt % (more preferably, 0.1 to 10 wt %;

most preferably, 1 to 5 wt %), based on the weight of the aqueous light duty liquid detergent formulation, of the zwitterionic surfactant).

Preferably, the aqueous light duty liquid detergent formulation of the present invention, comprises: 10 to 99 wt % (more preferably, 25 to 98 wt %; most preferably, 50 to 97 wt %), based on the weight of the aqueous light duty liquid detergent formulation, of a water. Preferable, the aqueous light duty liquid detergent formulation of the present invention, comprises 10 to 99 wt % (more preferably, 25 to 98 wt %; most preferably, 50 to 97 wt %), based on the weight of the aqueous light duty liquid detergent formulation, of a water, wherein the water is at least one of distilled water, deionized water and industrial soft water. More preferably, the aqueous light duty liquid detergent formulation of the present invention, comprises 10 to 99 wt % (more preferably, 25 to 98 wt %; most preferably, 50 to 97 wt %), based on the weight of the aqueous light duty liquid detergent formulation, of a water, wherein the water is distilled and deionized. Most preferably, the aqueous light duty liquid detergent formulation of the present invention, comprises 10 to 99 wt % (more preferably, 25 to 98 wt %; most preferably, 50 to 97 wt %), based on the weight of the aqueous light duty liquid detergent formulation, of a water, wherein the water is distilled, deionized and industrial soft to avoid introduction of undesirable metal ions to the aqueous light duty liquid detergent formulation.

Preferably, the aqueous light duty liquid detergent formulation of the present invention, comprises: 0.01 to 10 wt % (preferably, 0.1 to 5 wt %; more preferably, 0.25 to 3 wt %), based on the weight of the aqueous light duty liquid detergent formulation, of an essential oil. Preferably, the aqueous light duty liquid detergent formulation of the present invention, comprises: 0.01 to 10 wt % (preferably, 0.1 to 5 wt %; more preferably, 0.25 to 3 wt %), based on the weight of the aqueous light duty liquid detergent formulation, of an essential oil; wherein the essential oil comprises a citrus essential oil. More preferably, the aqueous light duty liquid detergent formulation of the present invention, comprises: 0.01 to 10 wt % (preferably, 0.1 to 5 wt %; more preferably, 0.25 to 3 wt %), based on the weight of the aqueous light duty liquid detergent formulation, of an essential oil; wherein the essential oil comprises a citrus essential oil selected from the group consisting of an orange essential oil (e.g., sweet orange essential oil, blood orange essential oil, bitter orange essential oil); a lemon essential oil; a lime essential oil; a grapefruit essential oil; a bergamot essential oil; a mandarin essential oil; a tangerine essential oil; a petitgrain essential oil; a neroli essential oil; a yuzu essential oil; and mixtures thereof. Still more preferably, the aqueous light duty liquid detergent formulation of the present invention, comprises: 0.01 to 10 wt % (preferably, 0.1 to 5 wt %; more preferably, 0.25 to 3 wt %), based on the weight of the aqueous light duty liquid detergent formulation, of an essential oil; wherein the essential oil comprises an orange essential oil. Most preferably, the aqueous light duty liquid detergent formulation of the present invention, comprises: 0.01 to 10 wt % (preferably, 0.1 to 5 wt %; more preferably, 0.25 to 3 wt %), based on the weight of the aqueous light duty liquid detergent formulation, of an essential oil; wherein the essential oil is an orange essential oil.

Preferably, the aqueous light duty liquid detergent formulation of the present invention, comprises: 0.01 to 25 wt % (more preferably, 0.05 to 10 wt %; still more preferably, 0.1 to 5 wt %; most preferably, 1 to 3 wt %), based on the weight of the aqueous light duty liquid detergent formulation, of a derivative of castor oil having a formula selected from formula I and formula II

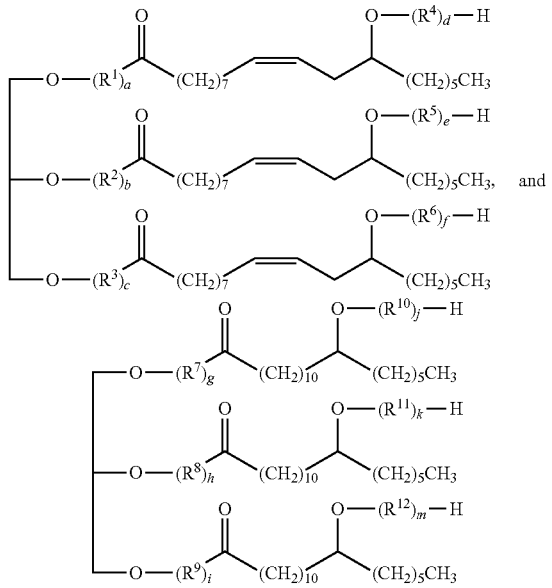

wherein $R^1$, $R^2$, $R^3$, $R^4$, $R^5$, $R^6$, $R^7$, $R^8$, $R^9$, $R^{10}$, $R^{11}$, and $R^{12}$ are each independently selected from a —$CH_2CH_2O$— group, a —$CH_2CH_2CH_2O$— group, a —$CH_2CH_2CH_2CH_2O$— group, a —$CH(CH_3)CH_2O$— group, a —$CH_2CH(CH_3)O$— group, a —$CH(CH_3)CH_2CH_2O$— group, a —$CH_2CH(CH_3)CH_2O$— group and a —$CH_2CH_2CH(CH_3)O$— group (preferably, a —$CH_2CH_2O$— group and a —$CH_2CH_2CH_2O$— group; more preferably, a —$CH_2CH_2O$— group); wherein a, b, c, d, e, f, g, h, i, j, k and m are each independently a number of 0 to 250; wherein the average sum of a+b+c+d+e+f is 1 to 250 (preferably, 5 to 200; more preferably, 10 to 60; most preferably, 15 to 30); wherein the average sum of g+h+i+j+k+m is 1 to 250 (preferably, 5 to 200; more preferably, 10 to 60; most preferably, 15 to 30).

Preferably, the aqueous light duty liquid detergent formulation of the present invention, comprises: 0.01 to 25 wt % (more preferably, 0.05 to 10 wt %; still more preferably, 0.1 to 5 wt %; most preferably, 1 to 3 wt %), based on the weight of the aqueous light duty liquid detergent formulation, of a derivative of castor oil having a formula selected from formula I and formula II, wherein the derivative of castor oil is a polyethylene glycol derivative of hydrogenated castor oil. More preferably, the aqueous light duty liquid detergent formulation of the present invention, comprises: 0.01 to 25 wt % (more preferably, 0.05 to 10 wt %; still more preferably, 0.1 to 5 wt %; most preferably, 1 to 3 wt %), based on the weight of the aqueous light duty liquid detergent formulation, of a derivative of castor oil having a formula selected from formula I and formula II, wherein the derivative of castor oil is selected from the group consisting of a PEG-5 hydrogenated castor oil, a PEG-5 castor oil, a PEG-7 hydrogenated castor oil, a PEG-7 castor oil, a PEG-16 hydrogenated castor oil, a PEG-16 castor oil, a PEG-25 hydrogenated castor oil, a PEG-25 castor oil, a PEG-30 hydrogenated castor oil, a PEG-30 castor oil, a PEG-40 hydrogenated castor oil, a PEG-40 castor oil, a PEG-60 hydrogenated castor oil, a PEG-60 castor oil, a PEG-100 hydrogenated castor oil, a PEG-100 castor oil, a PEG-200 hydrogenated castor oil, a PEG-200 castor oil and blends thereof. Still more preferably, the aqueous light duty liquid detergent formulation of the present invention, comprises: 0.01 to 25 wt % (more preferably, 0.05 to 10 wt %; still more preferably, 0.1 to 5 wt %; most preferably, 1 to 3 wt %), based on the weight of the aqueous light duty liquid detergent formulation, of a derivative of castor oil having a formula selected from formula I and formula II, wherein the derivative of castor oil is a polyethylene glycol derivative of hydrogenated castor oil selected from the group consisting of PEG-20 castor oil and blends including PEG-20 castor oil. Most preferably, the aqueous light duty liquid detergent formulation of the present invention, comprises: 0.01 to 25 wt % (more preferably, 0.05 to 10 wt %; still more preferably, 0.1 to 5 wt %; most preferably, 1 to 3 wt %), based on the weight of the aqueous light duty liquid detergent formulation, of a derivative of castor oil having a formula selected from formula I and formula II, wherein the derivative of castor oil is a PEG-20 castor oil.

Preferably, the aqueous light duty liquid detergent formulation of the present invention, comprises: 0.01 to 30 wt % (preferably, 0.1 to 20 wt %; more preferably, 1 to 10 wt %; most preferably, 2.5 to 7.5 wt %), based on the weight of the aqueous light duty liquid detergent formulation, of an ethoxylated phenol having formula III (III)

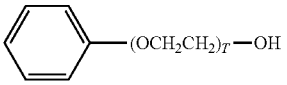

wherein T is an average of 5 to 8. More preferably, the aqueous light duty liquid detergent formulation of the present invention, comprises: 0.01 to 30 wt % (preferably, 0.1 to 20 wt %; more preferably, 1 to 10 wt %; most preferably, 2.5 to 7.5 wt %), based on the weight of the aqueous light duty liquid detergent formulation, of an ethoxylated phenol having formula III; wherein T is an average of 5.25 to 7.5. Yet still more preferably, the aqueous light duty liquid detergent formulation of the present invention, comprises: 0.01 to 30 wt % (preferably, 0.1 to 20 wt %; more preferably, 1 to 10 wt %; most preferably, 2.5 to 7.5 wt %), based on the weight of the aqueous light duty liquid detergent formulation, of an ethoxylated phenol having formula III; wherein T is an average of 5.5 to 7.25. Most preferably, the aqueous light duty liquid detergent formulation of the present invention, comprises: 0.01 to 30 wt % (preferably, 0.1 to 20 wt %; more preferably, 1 to 10 wt %; most preferably, 2.5 to 7.5 wt %), based on the weight of the aqueous light duty liquid detergent formulation, of an ethoxylated phenol having formula III; wherein T is an average of 5.75 to 6.25.

Preferably, the aqueous light duty liquid detergent formulation of the present invention, comprises: (preferably, 0.01 to 35 wt % (more preferably, 10 to 30 wt %; most preferably, 15 to 25 wt %), based on the weight of the aqueous light duty liquid detergent formulation, of an anionic surfactant. More preferably, the aqueous light duty liquid detergent formulation of the present invention, comprises: (preferably, 0.01 to 35 wt % (more preferably, 10 to 30 wt %; most preferably, 15 to 25 wt %), based on the weight of the aqueous light duty liquid detergent formulation, of an anionic surfactant; wherein the anionic surfactant is selected from the group consisting of alkyl sulfonic acids, alkyl sulfates, alkyl sulfonates, alkyl benzene sulfonic acid, alkyl benzene sulfates, alkyl benzene sulfonates, alkyl ether sulfonic acids, alkyl ether sulfates, alkyl ether sulfonates, alkoxylated alcohols, paraffin sulfonic acids, paraffin sulfates, paraffin sulfonates, olefin sulfonic acids, olefin sulfates, olefin sulfonates, alpha-sulfocarboxylates, esters of alpha-sulfocarboxylates, alkyl glyceryl ether sulfonic acids, alkyl glyceryl ether sulfates, alkyl glyceryl ether sulfonates, sulfates of fatty acids, sulfonates of fatty acids, sulfonates of fatty acid esters, alkyl phenols, alkyl phenol polyethoxy ether sulfates, 2-acryloxy-alkane-1-sulfonic acid, 2-acryloxy-alkane-1-sulfonate, beta-alkyloxy alkane sulfonic acid, beta-alkyloxy alkane sulfonate, amine oxides, salts thereof and mixtures thereof. Still more preferably, the aqueous light duty liquid detergent formulation of the present invention, comprises: (preferably, 0.01 to 35 wt % (more preferably, 10 to 30 wt %; most preferably, 15 to 25 wt %), based on the weight of the aqueous light duty liquid detergent formulation, of an anionic surfactant; wherein the anionic surfactant is selected from the group consisting of $C_{8-20}$ alkyl benzene sulfonic acid, $C_{8-20}$ alkyl benzene sulfates, $C_{8-20}$ alkyl benzene sulfonate, $C_{8-20}$ alkyl ether sulfonic acids, $C_{8-20}$ alkyl ether sulfates, $C_{8-20}$ alkyl ether sulfonates, paraffin sulfonic acid, paraffin sulfates, paraffin sulfonate, alpha-olefin sulfonic acid, alpha-olefin sulfate, alpha-olefin sulfonate, alkoxylated alcohols, $C_{8-20}$ alkyl phenols, amine oxides, sulfonates of fatty acids, sulfonates of fatty acid esters, salts thereof and mixtures thereof. Yet still more preferably, the aqueous light duty liquid detergent formulation of the present invention, comprises: (preferably, 0.01 to 35 wt % (more preferably, 10 to 30 wt %; most preferably, 15 to 25 wt %), based on the weight of the aqueous light duty liquid detergent formulation, of an anionic surfactant; wherein the anionic surfactant is selected from the group consisting of $C_{11-13}$ alkyl benzene sulfonic acid, $C_{11-13}$ alkyl benzene sulfonate, $C_{11-13}$ alkyl polyethoxy sulfonic acids, $C_{11-13}$ alkyl polyethoxy sulfates, $C_{11-13}$ alkyl polyethoxy sulfonates, salts thereof and mixtures thereof. Even more preferably, the aqueous light duty liquid detergent formulation of the present invention, comprises: (preferably, 0.01 to 35 wt % (more preferably, 10 to 30 wt %; most preferably, 15 to 25 wt %), based on the weight of the aqueous light duty liquid detergent formulation, of an anionic surfactant; wherein the anionic surfactant is selected from the group consisting of $C_{10-16}$ alkyl benzene sulfonic acid, $C_{10-16}$ alkyl benzene sulfonate, $C_{10-16}$ alkyl polyethoxy sulfonic acids, $C_{10-16}$ alkyl polyethoxy sulfates, $C_{10-16}$ alkyl polyethoxy sulfonates, salts thereof and mixtures thereof. Most preferably, the aqueous light duty liquid detergent formulation of the present invention, comprises: (preferably, 0.01 to 35 wt % (more preferably, 10 to 30 wt %; most preferably, 15 to 25 wt %), based on the weight of the aqueous light duty liquid detergent formulation, of an anionic surfactant; wherein the anionic surfactant includes (preferably, is) sodium laureth sulfate (SLES).

Preferably, the aqueous light duty liquid detergent formulation of the present invention, comprises: 0.01 to 15 wt % (more preferably, 0.1 to 10 wt %; most preferably, 1 to 5 wt %), based on the weight of the aqueous light duty liquid detergent formulation, of a zwitterionic surfactant. Preferably, the aqueous light duty liquid detergent formulation of the present invention, comprises: 0.01 to 15 wt % (more preferably, 0.1 to 10 wt %; most preferably, 1 to 5 wt %), based on the weight of the aqueous light duty liquid detergent formulation, of a zwitterionic surfactant; wherein the zwitterionic surfactant is selected from the group consisting of betaines, amine oxides, alkylamidoalkylamines, alkyl-substituted amine oxides, acylated amino acids, derivatives of aliphatic quaternary ammonium compounds and mixtures thereof. More preferably, the aqueous light duty liquid detergent formulation of the present invention, comprises: 0.01 to 15 wt % (more preferably, 0.1 to 10 wt %; most preferably, 1 to 5 wt %), based on the weight of the aqueous light duty liquid detergent formulation, of a zwitterionic surfactant; wherein the zwitterionic surfactant includes an amine oxide with a long chain group having 8 to 18 carbon atoms. Still more preferably, the aqueous light duty liquid detergent formulation of the present invention, comprises: 0.01 to 15 wt % (more preferably, 0.1 to 10 wt %; most preferably, 1 to 5 wt %), based on the weight of the aqueous light duty liquid detergent formulation, of a zwitterionic surfactant; wherein the zwitterionic surfactant includes a $C_{8-18}$ alkyl dimethylamine oxide. Yet still more preferably, the aqueous light duty liquid detergent formulation of the present invention, comprises: 0.01 to 15 wt % (more preferably, 0.1 to 10 wt %; most preferably, 1 to 5 wt %), based on the weight of the aqueous light duty liquid detergent formulation, of a zwitterionic surfactant; wherein the zwitterionic surfactant includes a $C_{10-14}$ alkyl dimethylamine oxide. Most preferably, the aqueous light duty liquid detergent formulation of the present invention, comprises: 0.01 to 15 wt % (more preferably, 0.1 to 10 wt %; most preferably, 1 to 5 wt %), based on the weight of the aqueous light duty liquid detergent formulation, of a zwitterionic surfactant; wherein the zwitterionic surfactant includes (preferably, is) a lauryl dimethylamine oxide.

Preferably, the aqueous light duty liquid detergent formulation of the present invention, further comprises: comprising 0 to 10 wt % (preferably, 0.01 to 10 wt %; more preferably, 1 to 7.5 wt %; most preferably, 3 to 5 wt %), based on the weight of the aqueous light duty liquid detergent formulation, of an organic solvent. Preferably, the aqueous light duty liquid detergent formulation of the present invention, further comprises: 0 to 10 wt % (preferably, 0.01 to 10 wt %; more preferably, 1 to 7.5 wt %; most preferably, 3 to 5 wt %), based on the weight of the aqueous light duty liquid detergent formulation, of an organic solvent; wherein the organic solvent is miscible with water. More preferably, the aqueous light duty liquid detergent formulation of the present invention, further comprises: 0 to 10 wt % (preferably, 0.01 to 10 wt %; more preferably, 1 to 7.5 wt %; most preferably, 3 to 5 wt %), based on the weight of the aqueous light duty liquid detergent formulation, of an organic solvent; wherein the organic solvent is selected from the group consisting of an aliphatic alcohol (e.g., $C_{1-6}$ alkanols, $C_{1-6}$ alkyl diols); a monoalkylene glycol ether (e.g., ethylene glycol propyl ether, ethylene glycol n-butyl ether, ethylene glycol t-butyl ether, propylene glycol propyl ether, propylene glycol n-butyl ether, propylene glycol t-butyl ether, propylene glycol methyl ether acetate, propylene glycol diacetate); a polyalkylene glycol ether (e.g., diethylene glycol ethyl ether, diethylene glycol propyl ether, diethylene glycol n-butyl ether, diethylene glycol t-butyl ether, diethylene glycol hexyl ether, dipropylene glycol methyl ether, dipropylene glycol ethyl ether, dipropylene glycol propyl ether, dipropylene glycol n-butyl ether, dipropylene glycol t-butyl ether, dipropylene glycol phenyl ether, dipropylene glycol methyl ether acetate, tripropylene glycol methyl ether, tripropylene glycol ethyl ether, tripropylene glycol propyl ether, tripropylene glycol n-butyl ether, tripropylene glycol t-butyl ether) and mixtures thereof. Still more preferably, the aqueous light duty liquid detergent formulation of the present invention, further comprises: 0 to 10 wt % (preferably, 0.01 to 10 wt %; more preferably, 1 to 7.5 wt %; most preferably, 3 to 5 wt %), based on the weight of the aqueous light duty liquid detergent formulation, of an organic solvent; wherein the organic solvent is selected from the group consisting of isopropanol, ethanol, 2-(2-butoxyethoxy)ethanol, ethylene glycol butyl ether, propylene glycol methyl ether, propylene glycol propyl ether, propylene glycol t-butyl ether, dipropylene glycol methyl ether, dipropylene glycol propyl ether, dipropylene glycol n-butyl ether and mixtures thereof. Yet more preferably, the aqueous light duty liquid detergent formulation of the present invention, further comprises: 0 to 10 wt % (preferably, 0.01 to 10 wt %; more preferably, 1 to 7.5 wt %; most preferably, 3 to 5 wt %), based on the weight of the aqueous light duty liquid detergent formulation, of an organic solvent; wherein the organic solvent includes ethanol. Most preferably, the aqueous light duty liquid detergent formulation of the present invention, further comprises: 0 to 10 wt % (preferably, 0.01 to 10 wt %; more preferably, 1 to 7.5 wt %; most preferably, 3 to 5 wt %), based on the weight of the aqueous light duty liquid detergent formulation, of an organic solvent; wherein the organic solvent is ethanol.

Preferably, the aqueous light duty liquid detergent formulation of the present invention, further comprises: 0 to 10 wt % (preferably, 0.1 to 10 wt %; more preferably, 0.5 to 7.5 wt %; most preferably, 1 to 5 wt %), based on the weight of the aqueous light duty liquid detergent formulation, of a hydrotrope. More preferably, the aqueous light duty liquid detergent formulation of the present invention, further comprises: 0 to 10 wt % (preferably, 0.1 to 10 wt %; more preferably, 0.5 to 7.5 wt %; most preferably, 1 to 5 wt %), based on the weight of the aqueous light duty liquid detergent formulation, of a hydrotrope; wherein the hydrotrope is selected from the group consisting of urea; monoethanolamine; diethanolamine; triethanolamine; and calcium, sodium, potassium, ammonium and alkanol ammonium salts of xylene sulfonic acid, toluene sulfonic acid, ethylbenzene sulfonic acid and cumene sulfonic acid; and mixtures thereof. Still more preferably, the aqueous light duty liquid detergent formulation of the present invention, further comprises: 0 to 10 wt % (preferably, 0.1 to 10 wt %; more preferably, 0.5 to 7.5 wt %; most preferably, 1 to 5 wt %), based on the weight of the aqueous light duty liquid detergent formulation, of a hydrotrope; wherein the hydrotrope is selected from the group consisting of sodium toluene sulfonate, potassium toluene sulfonate, sodium xylene sulfonate, ammonium xylene sulfonate, potassium xylene sulfonate, calcium xylene sulfonate, sodium cumene sulfonate, ammonium cumene sulfonate and mixtures thereof. Yet still more preferably, the aqueous light duty liquid detergent formulation of the present invention, further comprises: 0 to 10 wt % (preferably, 0.1 to 10 wt %; more preferably, 0.5 to 7.5 wt %; most preferably, 1 to 5 wt %), based on the weight of the aqueous light duty liquid detergent formulation, of a hydrotrope; wherein the hydrotrope includes sodium xylene sulfonate. Most preferably, the aqueous light duty liquid detergent formulation of the present invention, further comprises: 0 to 10 wt % (preferably, 0.1 to 10 wt %; more preferably, 0.5 to 7.5 wt %; most preferably, 1 to 5 wt %), based on the weight of the aqueous light duty liquid detergent formulation, of a hydrotrope; wherein the hydrotrope is sodium xylene sulfonate.

Preferably, the aqueous light duty liquid detergent formulation of the present invention, further comprises an additive. Preferably, the aqueous light duty liquid detergent formulation of the present invention, further comprises an additive selected from the group consisting of a salt, a builder, an enzyme, a corrosion inhibitor, an acid, a bleaching agent, an abrasive, an antimicrobial agent, a chelating agent, an additional surfactant, a pH adjuster, a buffering agent and mixtures thereof.

Preferably, the method of manually washing an article of the present invention, includes: providing an article, wherein the article is selected from the group consisting of at least one of dishware, glassware, flatware, pots, pans and delicate clothing (preferably, wherein the article is selected from the group consisting of at least one of dishware, glassware, flatware, pots and pans; more preferably, wherein the article is selected from the group consisting of at least one of dishware, glassware and flatware); providing an aqueous light duty liquid detergent formulation of the present invention; manually contacting the article with the aqueous light duty liquid detergent formulation; and rinsing the aqueous light duty liquid detergent formulation from the article.

Some embodiments of the present invention will now be described in detail in the following Examples.

Comparative Examples C1-C12 and Examples 1-4

Aqueous Light Duty Liquid Detergent Formulation

Aqueous light duty liquid detergent formulations of Comparative Examples C1-C12 and Examples 1-4 were prepared by mixing together the components in the weight proportions noted in Table 1. The aqueous light duty liquid detergent formulations of Comparative Examples C1-C12 and Examples 1-4 were observed for formulational stability from phase separation. The results of those observations are reported TABLE 2.

TABLE 1

| | Material | | | | | | | | |
|---|---|---|---|---|---|---|---|---|---|
| Ex. | A (wt %) | B (wt %) | C (wt %) | D (wt %) | E (wt %) | F (wt %) | G (wt %) | H (wt %) | I (wt %) |
| C1 | 0.50 | 4.50 | 0 | 0 | 0 | 20.00 | 3.00 | 4.00 | 68.00 |
| C2 | 0.75 | 4.61 | 0 | 0 | 0 | 20.00 | 3.00 | 4.00 | 67.64 |
| C3 | 1.00 | 4.56 | 0 | 0 | 0 | 20.00 | 3.00 | 4.00 | 67.44 |
| C4 | 1.50 | 5.32 | 0 | 0 | 0 | 20.00 | 3.00 | 4.00 | 66.18 |
| C5 | 0.50 | 2.00 | 0 | 2.50 | 0 | 20.00 | 3.00 | 4.00 | 68.00 |
| C6 | 0.50 | 2.00 | 0 | 0 | 2.50 | 20.00 | 3.00 | 4.00 | 68.00 |
| C7 | 0.75 | 2.04 | 0 | 2.57 | 0 | 20.00 | 3.00 | 4.00 | 67.64 |
| C8 | 0.75 | 2.04 | 0 | 0 | 2.57 | 20.00 | 3.00 | 4.00 | 67.64 |
| C9 | 1.00 | 2.00 | 0 | 2.56 | 0 | 20.00 | 3.00 | 4.00 | 67.44 |
| C10 | 1.00 | 2.00 | 0 | 0 | 2.56 | 20.00 | 3.00 | 4.00 | 67.44 |
| C11 | 1.50 | 2.39 | 0 | 2.93 | 0 | 20.00 | 3.00 | 4.00 | 66.18 |
| C12 | 1.50 | 2.39 | 0 | 0 | 2.93 | 20.00 | 3.00 | 4.00 | 66.18 |
| 1 | 0.50 | 2.00 | 2.50 | 0 | 0 | 20.00 | 3.00 | 4.00 | 68.00 |
| 2 | 0.75 | 2.04 | 2.57 | 0 | 0 | 20.00 | 3.00 | 4.00 | 67.64 |
| 3 | 1.00 | 2.00 | 2.56 | 0 | 0 | 20.00 | 3.00 | 4.00 | 67.44 |
| 4 | 1.50 | 2.39 | 2.93 | 0 | 0 | 20.00 | 3.00 | 4.00 | 66.18 |

A - Orange essential oil available from Wellington Fragrance Co.

B - Tergitol ™ ECO-20 ethoxylated castor oil derivative

C - Dowanol ™ EPh6 polyethylene glycol phenyl ether of formula III, wherein T is an average of 6

D - Dowanol ™ EPh4 polyethylene glycol phenyl ether of formula III, wherien T is an average of 4

E - Dowanol ™ diEPh polyethylene glycol phenyl ether of formula III, wherien T is an average of 2

F - Sodium laureth sulfate

G - Lauryl dimethylamine oxide

H - Ethanol

I - Deionized water

TABLE 2

| Example | Phase separated |
|---|---|
| C1 | Yes |
| C2 | Yes |
| C3 | Yes |
| C4 | Yes |
| C5 | Yes |
| C6 | Yes |
| C7 | Yes |
| C8 | Yes |
| C9 | Yes |
| C10 | Yes |
| C11 | Yes |
| C12 | Yes |
| 1 | No |
| 2 | No |
| 3 | No |
| 4 | No |

We claim:

1. An aqueous light duty liquid detergent formulation, comprising: a water; an essential oil; a derivative of castor oil having a formula selected from formula I and formula II (I)

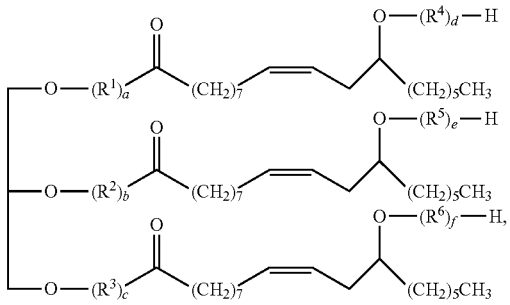

(II)

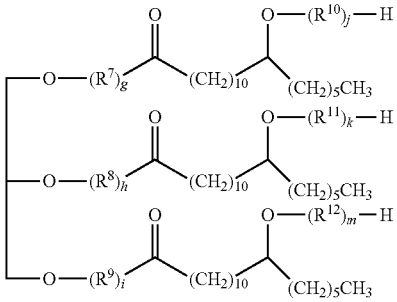

wherein $R^1$, $R^2$, $R^3$, $R^4$, $R^5$, $R^6$, $R^7$, $R^8$, $R^9$, $R^{10}$, $R^{11}$, and $R^{12}$ are each independently selected from a —$CH_2CH_2O$— group, a —$CH_2CH_2CH_2O$— group, a —$CH_2CH_2CH_2CH_2O$— group, a —$CH(CH_3)CH_2O$— group, a —$CH_2CH(CH_3)O$— group, a —$CH(CH_3)CH_2CH_2O$— group, a —$CH_2CH(CH_3)CH_2O$— group and a —$CH_2CH_2CH(CH_3)O$— group; wherein a, b, c, d, e, f, g, h, i, j, k and m are each independently a number of 0 to 250; wherein the average sum of a+b+c+d+e+f is 1 to 250; wherein the average sum of g+h+i+j+k+m is 1 to 250; an ethoxylated phenol having formula III (III)

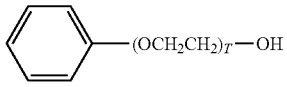

wherein T is an average of 5 to 8; an anionic surfactant and a zwitterionic surfactant.

2. The aqueous light duty liquid detergent formulation of claim 1, further comprising 0.01 to 10 wt %, based on the weight of the aqueous light duty liquid detergent formulation, of an organic solvent.

3. The aqueous light duty liquid detergent formulation of claim 1, wherein the anionic surfactant is a sodium lauryl ether sulfate.

4. The aqueous light duty liquid detergent formulation of claim 1, wherein the zwitterionic surfactant is an alkyl-substituted amine oxide.

5. The aqueous light duty liquid detergent formulation of claim 1, wherein the zwitterionic surfactant is a $C_{10-14}$ alkyl dimethylamine oxide.

6. The aqueous light duty liquid detergent formulation of claim 1, further comprising 0.1 to 10 wt %, based on the weight of the aqueous light duty liquid detergent formulation, of a hydrotrope.

7. The aqueous light duty liquid detergent formulation of claim 1, wherein the essential oil is a citrus essential oil.

8. The aqueous light duty liquid detergent formulation of claim 1, wherein the essential oil is an orange essential oil.

9. The aqueous light duty liquid detergent formulation of claim 1, wherein the aqueous cleaning formulation contains 50 to 97 wt %, based on the weight of the aqueous light duty liquid detergent formulation, of the water;

0.01 to 5 wt %, based on the weight of the aqueous light duty liquid detergent formulation, of the essential oil, wherein the essential oil is a citrus essential oil;

1 to 3 wt %, based on the weight of the aqueous light duty liquid detergent formulation, of the derivative of the derivative of castor oil having a formula selected from formula I and formula II, wherein $R^1$, $R^2$, $R^3$, $R^4$, $R^5$, $R^6$, $R^7$, $R^8$, $R^9$, $R^{10}$, $R^{11}$, and $R^{12}$ are each a —$CH_2CH_2O$— group; wherein a, b, c, d, e, f, g, h, i, j, k and m are each independently a number of 0 to 250; wherein the average sum of a+b+c+d+e+f is 1 to 250; wherein the average sum of g+h+i+j+k+m is 1 to 250;

2.5 to 7.5 wt %, based on the weight of the aqueous light duty liquid detergent formulation, of the ethoxylated phenol having formula III, wherein T is an average of 5.75 to 6.25; and 0.01 to 30 wt %, based on the weight of the aqueous light duty liquid detergent formulation of the anionic surfactant, wherein the anionic surfactant is a sodium laureth sulfate;

1 to 5 wt %, based on the weight of the aqueous light duty liquid detergent formulation of the zwitterionic surfactant; wherein the zwitterionic surfactant is lauryl dimethylamine oxide.

10. A method of manually washing an article, comprising:

providing an article, wherein the article is selected from the group consisting of at least one of dishware, glassware, flatware, pots, pans and delicate clothing;

providing an aqueous light duty liquid detergent formulation of claim 1;

manually contacting the article with the aqueous light duty liquid detergent formulation; and rinsing the aqueous light duty liquid detergent formulation from the article.

* * * * *